US012687295B2

(12) United States Patent
Wood

(10) Patent No.: US 12,687,295 B2
(45) Date of Patent: Jul. 21, 2026

(54) FIRE-STARTER

(71) Applicant: Jesse Glenn Wood, San Jose, CA (US)

(72) Inventor: Jesse Glenn Wood, San Jose, CA (US)

( * ) Notice: Subject to any disclaimer, the term of this patent is extended or adjusted under 35 U.S.C. 154(b) by 369 days.

(21) Appl. No.: 18/377,221

(22) Filed: Oct. 5, 2023

(65) Prior Publication Data

US 2025/0116401 A1 Apr. 10, 2025

(51) Int. Cl.
*F23Q 1/06* (2006.01)

(52) U.S. Cl.
CPC ..... *F23Q 1/06* (2013.01)

(58) Field of Classification Search
CPC ..... F23Q 1/06
USPC ..... 431/274
See application file for complete search history.

(56) References Cited

U.S. PATENT DOCUMENTS

2017/0299180 A1* 10/2017 Holland ..... F23Q 1/06

FOREIGN PATENT DOCUMENTS

CN 211502865 U * 9/2020

* cited by examiner

*Primary Examiner* — Allen R. B. Schult
*Assistant Examiner* — William C Weinert
(74) *Attorney, Agent, or Firm* — Zilka-Kotab, P.C.

(57) ABSTRACT

A fire-starter, according to one approach, includes: an outer shell having an upper end, as well as sidewalls coupled to the upper end. Together, the sidewalls and upper end form an interior portion of the outer shell. The fire-starter also includes a first opening in the outer shell, the first opening being configured to receive a spark rod and provide access to the interior portion of the outer shell. Furthermore, a blade is positioned in the interior portion of the outer shell and adjacent to the first opening. Accordingly, the blade is configured to come into contact with a spark rod that is inserted in the first opening. The blade is also configured to generate sparks in the interior portion of the outer shell in response to the spark rod being removed from the first opening while in contact with the blade.

20 Claims, 13 Drawing Sheets

FIRE-STARTER

FIELD OF THE INVENTION

The present invention relates to fire-starters, and more particularly, this invention relates to manual spark generating fire-starters.

BACKGROUND

Many different conventional fire-starters exist in the marketplace today. For instance, lighters, matches, chemical reactions, spark rods, and other types of mechanisms have been used to generate sparks and/or flames that can be used to ignite a fuel source such as tinder. While fire-starters that produce small flames are easier to ignite a fuel source, they have conventionally required a fast-burning fuel source to be consumed. For example, lighters are able to produce a small flame by igniting and burning a liquid fuel source, e.g., such as butane or naphthalene. As a result, these conventional fire-starters require to be refilled frequently and have a higher upkeep cost.

Conversely, conventional fire-starters that produce sparks typically utilize a fuel source that is consumed more slowly. While this prolongs the useable lifetime of a fire-starter, these conventional fire-starters are significantly difficult to use. More specifically, conventional fire-starters are inefficient in producing sparks as well as delivering them securely to a fuel source (e.g., tinder). These conventional fire-starters produce sparks that scatter in all directions, and which are exposed to whatever ambient environment the user is located in.

It follows that conventional fire-starters have suffered from several inefficiencies that have limited use and applicability over time. These conventional fire-starters tend to increase user interaction, ultimately decreasing their effectiveness and ease of operation. Therefore, it would be beneficial to have a fire-starter product which possesses a more efficient design and/or functional properties that help facilitate fire generation.

SUMMARY

A fire-starter, according to one approach, includes: an outer shell having an upper end, as well as sidewalls coupled to the upper end. Together, the sidewalls and upper end form an interior portion of the outer shell. The fire-starter also includes a first opening in the outer shell, the first opening being configured to receive a spark rod and provide access to the interior portion of the outer shell. Furthermore, a blade is positioned in the interior portion of the outer shell and adjacent to the first opening. Accordingly, the blade is configured to come into contact with a spark rod that is inserted in the first opening. The blade is also configured to generate sparks in the interior portion of the outer shell in response to the spark rod being removed from the first opening while in contact with the blade.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred approaches of a fire-starter and/or related systems and methods.

In one general approach, a fire-starter includes: an outer shell having an upper end, as well as sidewalls coupled to the upper end. Together, the sidewalls and upper end form an interior portion of the outer shell. The fire-starter also includes a first opening in the outer shell, the first opening being configured to receive a spark rod and provide access to the interior portion of the outer shell. Furthermore, a blade is positioned in the interior portion of the outer shell and adjacent to the first opening. Accordingly, the blade is configured to come into contact with a spark rod that is inserted in the first opening. The blade is also configured to generate sparks in the interior portion of the outer shell in response to the spark rod being removed from the first opening while in contact with the blade.

Figure 1A:
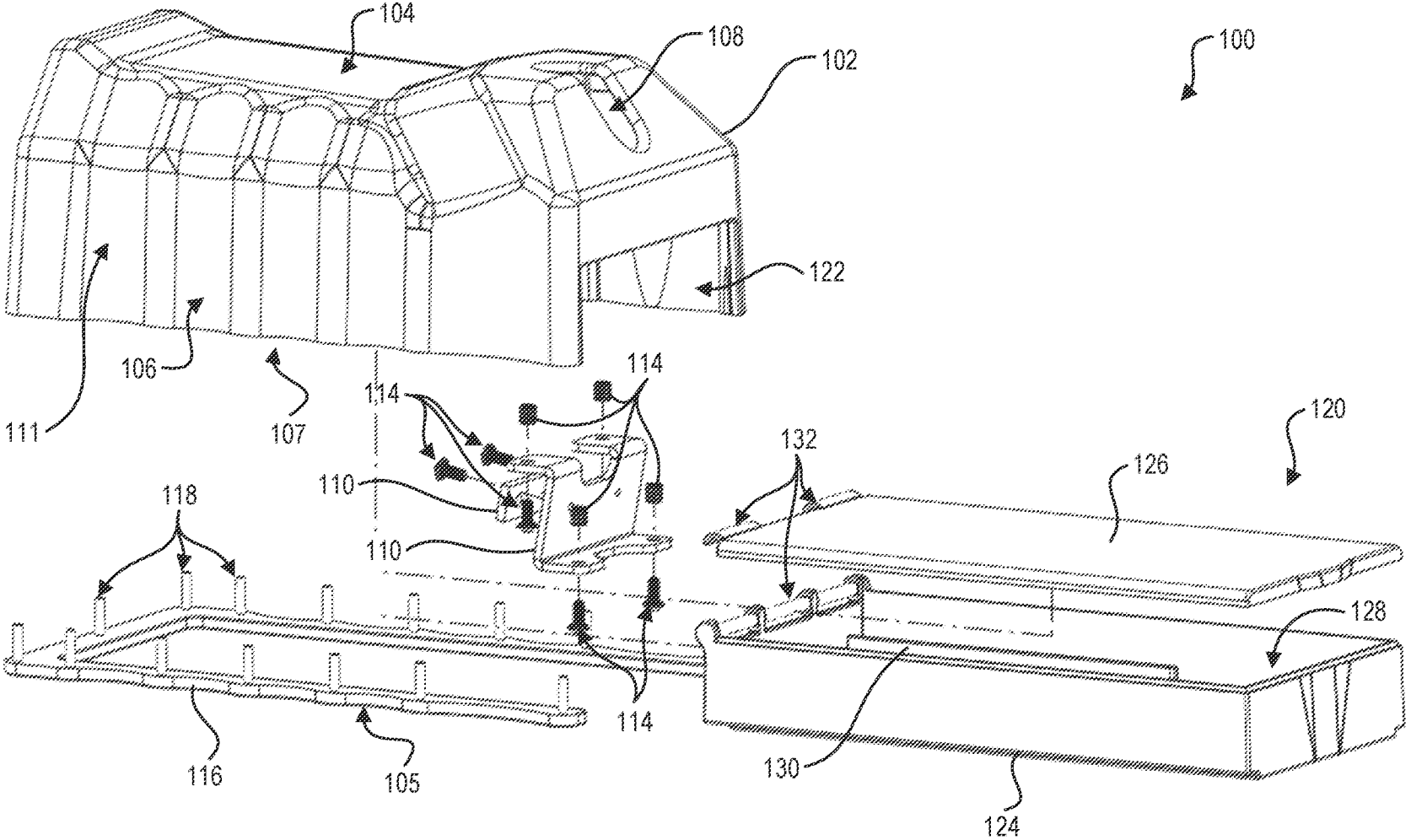
FIG. 1A is an exploded view of a fire-starter, according to one approach.
Figure 1B:
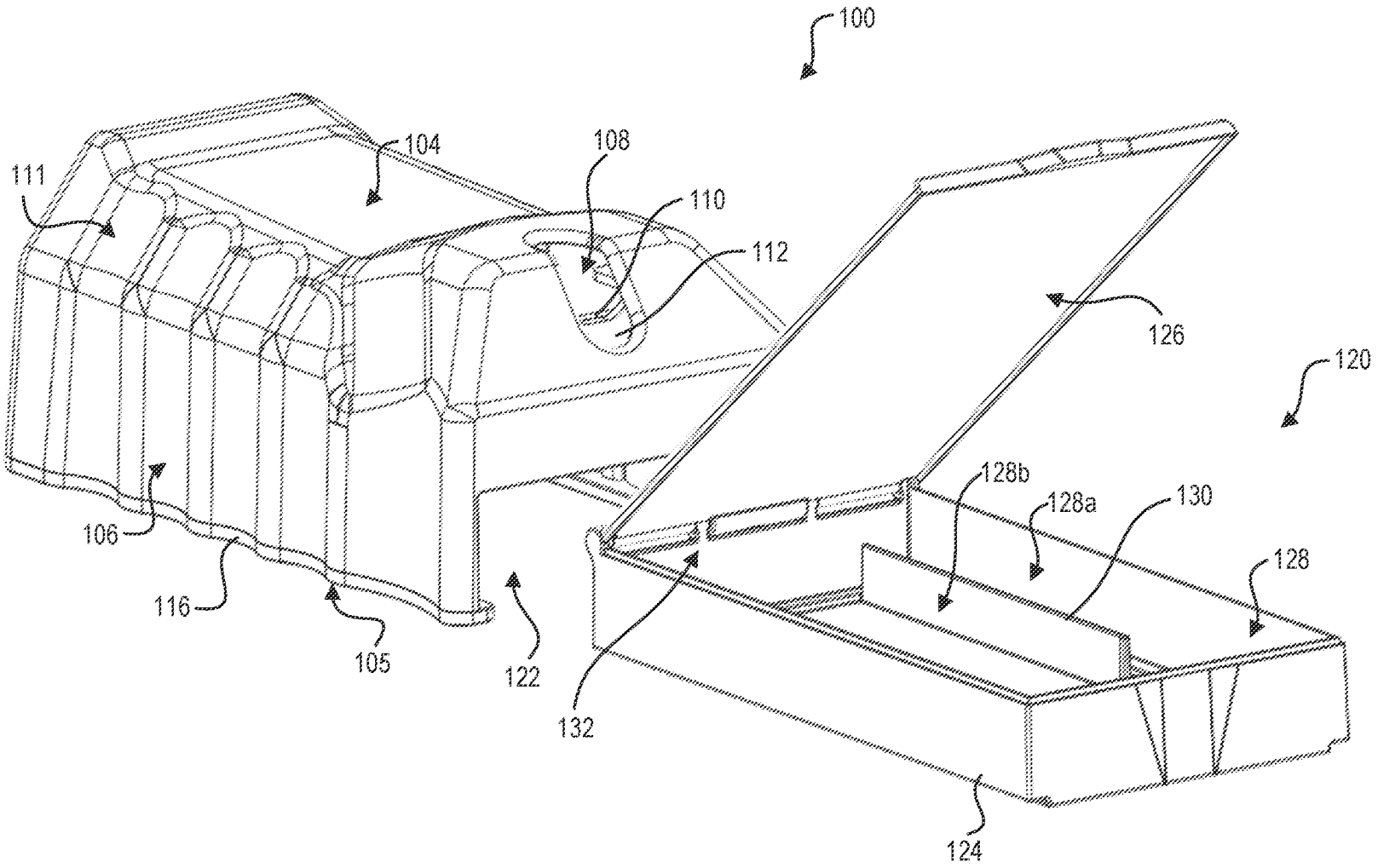
FIG. 1B is a partial perspective view of the fire-starter in FIG. 1A, with a tray in the open position, according to one approach.

Looking to FIGS. 1A-1B, several views of a fire-starter 100 are shown in accordance with one implementation. As an option, the present fire-starter 100 may be implemented in conjunction with features from any other approach listed herein, such as those described with reference to the other FIGS. However, such fire-starter 100 and others presented herein may be used in various applications and/or in permutations which may or may not be specifically described in the illustrative approaches listed herein. Further, the fire-starter 100 presented herein may be used in any desired environment. Thus FIGS. 1A-1B (and the other FIGS.) may be deemed to include any possible permutation.

Referring first to FIG. 1A, an exploded view of the fire-starter 100 is shown such that each of the components therein are clearly visible. An outer shell 102 of the fire-starter 100 forms a general profile of the device. The outer shell 102 includes an upper end 104 and sidewalls 106 that are coupled together to form an interior portion 107 of the outer shell 102. The interior portion 107 includes the recessed portion of the outer shell 102 extending from the lower end 105 to an inner surface of the upper end 104.

This interior portion 107 is particularly apparent in situations where the lower end 105 of the outer shell 102 is placed against a surface, e.g., like the ground. This effectively covers the bottom open end of the outer shell 102. It should be noted that with respect to the present description, the "open end" of the outer shell 102 refers to the bottom end on an opposite side of the sidewalls 106 as the upper end 104. In other words, the bottom of the outer shell 102 is open.

In preferred approaches, the outer shell 102 is formed in a single process such that the upper end 104 and sidewalls 106 are effectively portions of a uniform piece of material. However, in other approaches the upper end 104 may be coupled to the sidewalls 106 using one or more fasteners, adhesives, interlocking features, etc., to for the outer shell 102. An illustrative and non-limiting list of materials that may be used to form the outer shell 102 and/or any of the components therein, includes one or more plastics, metals, rubbers, etc., and/or combinations thereof.

An outer (e.g., exterior) surface of the outer shell 102 may be textured and/or patterned in some approaches. For instance, the outer surface of the outer shell 102 may have finger groves (e.g., see groves 111 in FIGS. 1A-1C) that are positioned and designed to facilitate a secure grip for a user. Thus, in some approaches the finger groves may also be textured, e.g., with a knurling pattern. In still other approaches, different types of materials may be implemented along the outer surface of the outer shell 102.

For example, a rubberized material may be affixed to the outer surface of the outer shell 102 to improve the tactile response for a user. It follows that depending on the desired implementation, different designs and features may be implemented along the exterior (e.g., outer surface) of the outer shell 102. According to another example, a color pattern configured to reflect more thermal energy received from exposure to sunlight may be implemented in conjunction with specific texturing and/or dimensions to help facilitate heat transfer away from the interior of the fire-starter 100 to keep any kindling, accelerants, etc., that may be stored therein cool to prevent unintended combustion.

Referring still to FIG. 1A, an opening 108 (e.g., hole) in the outer shell 102 provide access to the interior portion 107 of the outer shell 102. The opening 108 is also preferably configured to receive a spark rod that is inserted therein. Accordingly, the size of the opening 108 is preferably at least as large as typical spark rods. For instance, some approaches may incorporate an opening 108 having a diameter of about 1 inch, while in other approaches the diameter may be between about 0.5 inches and about 3 inches, more preferably between about 1 inch and about 2 inches, but could be wider or narrower depending on the desired approach. Moreover, the interior portion 107 may be configured to accommodate a spark rod that is about 10 inches in length, more preferably about 8 inches in length, still more preferably about 7 inches in length, more preferably about 6 inches in length, etc., but could be configured to accommodate spark rods of different dimensions.

The opening 108 also preferably provides access to a blade 110 that is positioned adjacent to the opening 108. As shown, the blade 110 is removably coupled to a bracket 112 by a number of fasteners 114. The bracket 112 is further removably coupled to the outer shell 102 by several fasteners 114 such that an edge of the blade 110 is exposed (e.g., accessible) in the interior portion 107 along the opening 108 (e.g., see FIGS. 1B-1C and FIG. 2A).

Figure 1C:
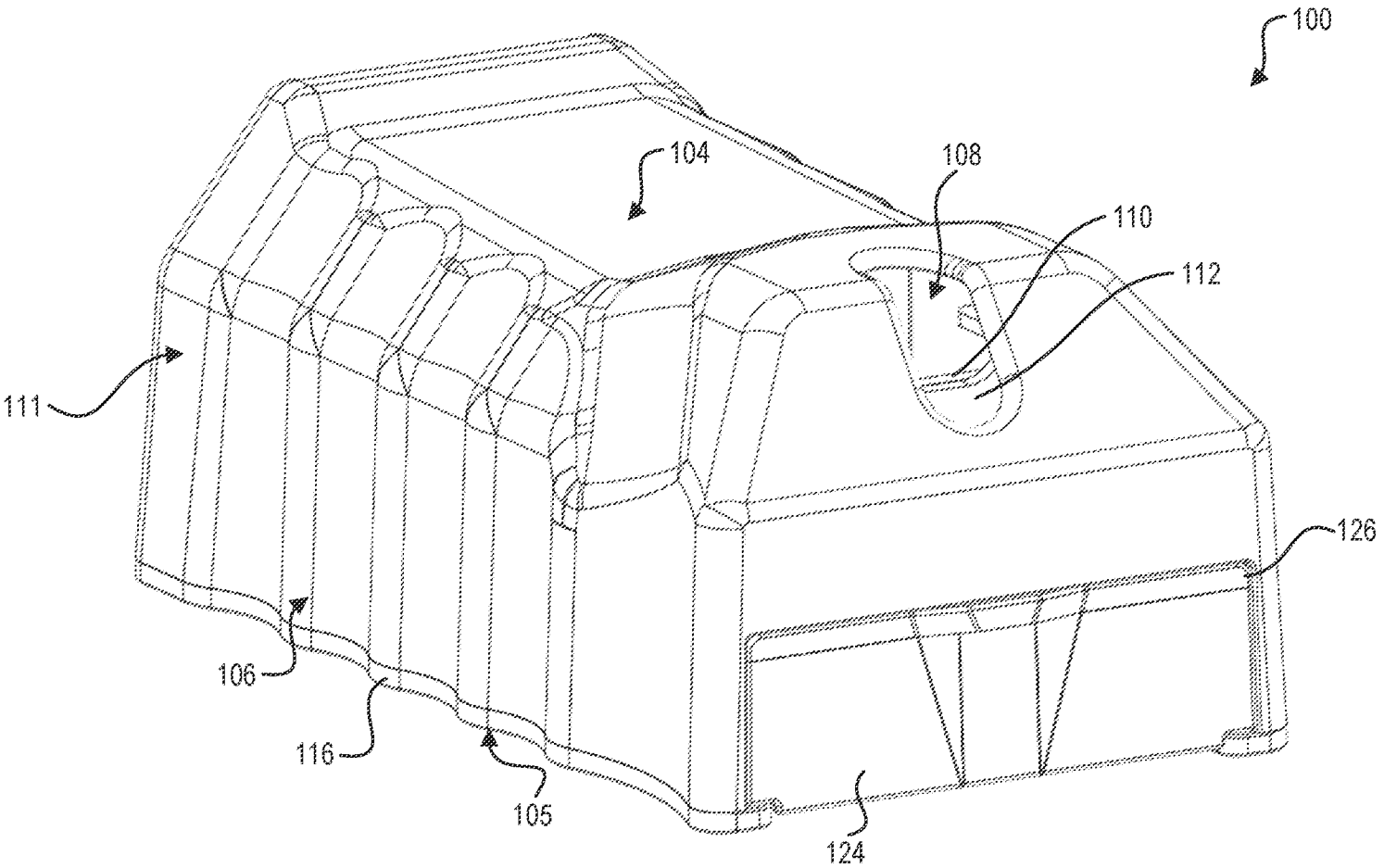
FIG. 1C is a partial perspective view of the fire-starter in FIG. 1A, with a tray in the secured position, according to one approach.
Figure 2A:
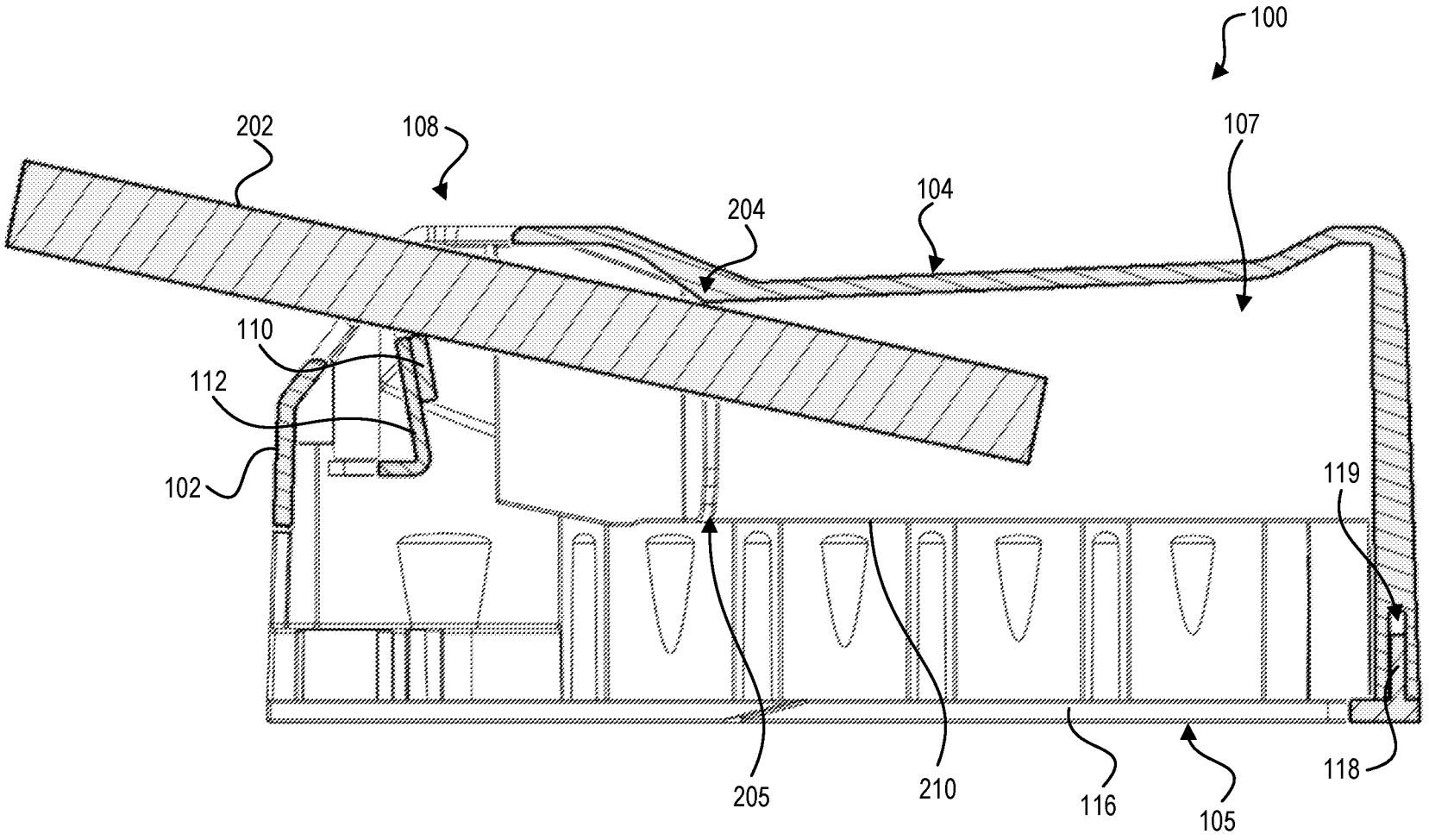
FIG. 2A is a partial cross-sectional view of a fire-starter with a spark rod inserted therein, according to one approach.

It follows that the blade 110 is preferably positioned in the interior portion 107 of the outer shell 102 such that it comes into contact with objects that are inserted into the opening 108. In other words, the blade 110 is positioned adjacent to the opening 108 such that it comes into contact with a spark rod that is inserted in the opening 108. Referring momentarily to FIG. 2A, a cross-sectional view of the fire-starter 100 in FIGS. 1A-1C is shown in accordance with one implementation. Accordingly, various components of FIG. 2A have common numbering with those of FIGS. 1A-1C.

As shown, the opening 108 in the outer shell 102 is large enough to receive a spark rod 202. The opening 108, in combination with the position of the blade 110 and bracket 112, as well as the guide ramp 204 and arms 205 along the upper end 104, work in combination to direct the spark rod 202 along a preferred orientation. For instance, the arms 205 extend from the upper end 104 and interior walls 210 to form a chamber 207 that is configured to contain any sparks that are produced against the blade 110 which is adjacent thereto. According to some approaches, the arms 205 and interior walls 210 may form a chamber 207 that is about one quarter the overall dimensions of the fire-starter 100 profile. In other words, the sparks produced by the blade 110 may be confined to deliver a higher number of sparks to kindling or some other fuel source that is placed in the chamber 207, e.g., to increase the chances of producing a flame.

As noted above, a spark rod 202 inserted into the opening 108 preferably comes into contact with a blade 110. While some approaches achieve this contact by passively directing spark rods 202 inserted into the opening 108, some approaches implement a biasing mechanism that is configured to direct a spark rod 202 inserted into the first opening 108 towards the blade 110, and exert a force on the spark rod 202 while the spark rod is in contact with the blade 110. For example, see biasing mechanisms 500 in FIGS. 5A-5C below.

Referring still to FIG. 2A, it follows that the fire-starter 100 is able to generate sparks in the interior portion 107 of the outer shell 102 in response to a spark rod 202 being inserted and/or removed from the first opening 108 such that the spark rod 202 scrapes against the blade 110. With respect to the present description, it should be noted that a "spark rod" may include any desired type of material that is able to produce sparks as a result of applying heat (e.g., friction) and/or oxygen (e.g., for oxidation). According to an example, which is in no way intended to be limiting, a spark rod inserted into the fire-starter 100 may include ferrocerium.

Ferrocerium rods, commonly referred to as "ferro rods", use ferrocerium which is a man-made metallic material that produces sparks when struck by a harder material (e.g., such as steel). Ferrocerium is an alloy that usually contains iron, cerium, and small amounts of other metals like magnesium, praseodymium, and neodymium. Thus, when ferrocerium is scraped or struck with a hard (and ideally sharp) striker, shards of the ferrocerium are shaved off and ignited due to the friction, producing hot sparks that can reach temperatures of 3,000 degrees Celsius (5,430 degrees Fahrenheit). These sparks can be used to ignite tinder and start a fire.

Using ferrocerium is particularly desirable due to its weather resistance, but is in no way limiting. For example, some approaches may use magnesium shavings in combination with a spark generating material like ferrocerium. Unlike matches or lighters, spark rods that use materials like magnesium, ferrocerium, etc., work even when wet. This makes them ideal for use in challenging conditions.

A single spark rod can also be used thousands of times, has no moving parts, and are relatively lightweight. Preferably, the fire-starter is used in combination with quality tinder, e.g., such as dry grass, birch bark, cotton balls, etc. As noted above, the tinder is preferably placed in the interior portion 107 of the outer shell 102, such that the tinder is protected from any gusts of wind or moisture. Placing the tinder inside the outer shell 102 also helps direct the sparks that are generated towards the tinder. Thus, rather than moving the outer shell 102 and blade 110, it is often more desirable to keep the blade stationary, while pulling the spark rod against the blade 110. This further helps direct the generated sparks to the tinder rather than being scattered.

It follows that, by scraping the spark rod 202 against the blade 110, fragments are removed from the rod and exposed to oxygen in the air, thereby oxidizing the fragments of the spark rod and causing them to ignite due to the remarkably low ignition temperature of spark rod materials (e.g., ferrocerium), which can be around 325 degrees Fahrenheit).

Moreover, because the blade is positioned in the interior portion 107 of the outer shell, the sparks that are produced by scraping the spark rod 202 against the blade 110 are kept inside the fire-starter 100. This effectively protects the sparks that are produced and directs them towards whatever is located in the interior portion 107. For example, tinder (e.g., fuel for fire) may be placed on a surface, and the fire-starter 100 may be placed directly over the tinder, such that the tinder is positioned in the interior portion 107. As a result, sparks produced by scraping a spark rod against the blade 110 are directed to the tinder and protected from harsh conditions, like gusts of wind and desirably improves the chances of the sparks igniting the tinder and starting a fire.

Returning now to FIG. 1A, in some approaches a bottom layer 116 is coupled to a bottom of the outer shell 102. In other words, a first end of the sidewalls 106 are coupled to the upper end 104 of the outer shell 102, while a second end of the sidewalls 106 (opposite the first end) are coupled to the bottom layer 116 which defines a bottom of the outer shell 102.

For instance, a number of protrusions 118 may be configured to be inserted into corresponding recesses positioned along a bottom of the sidewalls 106 (e.g., see protrusion 118 inserted in recess 119 of FIG. 2A). However, the bottom layer 116 may be connected to the outer shell 102 using one or more adhesives, fasteners, friction fittings, etc. For example, fasteners may be inserted into some of the protrusions 118 and used to secure the bottom layer 116 to the outer shell 102. According to some approaches, a fastener may be used to connect the protrusion 118 at each corner of the bottom layer 116. A fastener may also be used to ones of the protrusions 118 that align with arms inside the interior portion 107 (e.g., see arms 205 and/or interior walls 210 of FIGS. 2A-2B). The bottom layer 116 may be made of a material that is different than a remainder of the outer shell 102. For example, the bottom layer 116 may include a rubberized material that secures the fire-starter 100 from sliding along a supporting surface as a result of the forces applied by a user to generate sparks as described herein. In another example, the bottom layer 116 may be easily replaceable to avoid causing damage to a bottom of the fire-starter 100 from use.

The fire-starter 100 is also shown as being configured to receive a tray 120. Depending on the approach, the sidewalls 106 and/or interior portion 107 may be configured such that the tray 120 is "received" differently. In some instances, opening 122 in the outer shell 102 is shaped such that the tray 120 may be slid into the opening 122. It follows that the tray 120 and the outer shell 102 may be removably coupled to each other in response to the tray 120 being slid into a secured position.

For example, FIG. 1B shows the tray 120 fully removed from the opening 122 with the lid 126 open, while FIG. 1C shows the tray 120 fully inserted into the opening such that the tray 120 and outer shell 102 are in a secured position. In this position, the tray 120 and outer shell 102 may be removably coupled to each other by one or more magnets, detents, etc., that exert a relatively high amount of static friction preventing motion of the tray 120 relative to the outer shell 102. It follows that the lid 126 may be connected to a remainder of the tray 120 by a hinge 132.

In some approaches, a locking mechanism may be used to more securely couple the tray 120 to the outer shell 102. In other words, locking mechanisms may be used to secure the tray 120 in the secured position relative to a remainder of the fire-starter 100 (e.g., as seen in FIG. 1C). For instance, the fire-starter may include one or more latches, bolts, fasteners, hooks, etc., that are configured to selectively prevent the tray 120 from being removed from the opening 122.

However, it should be noted that the tray 120 may be selectively coupled to the outer shell 102 differently depending on the approach. For example, the tray 120 may have an upper form factor that is configured to interlock with (e.g., nestle into) the interior portion 107 of the outer shell 102. It follows that the outer shell 102 may simply be stacked on top of the tray 120 to selectively couple the two together.

Referring still to FIGS. 1A-1C, the tray 120 includes a body 124 and a lid 126. As shown, the body 124 further includes a base having bottom and sidewalls that form a recessed area 128. While the recessed area 128 is exposed (e.g., accessible) while the lid 126 is open, the lid 126 is preferably configured to be removably coupled to the body 124 of the tray 120 to cover the recessed area 128.

In the recessed area 128, a partition 130 separates a first area from a remainder of the recessed area 128. In preferred approaches, the first area 128*a* is configured to receive and secure a spark rod therein while the lid 126 is closed (e.g., removably coupled to the body of the tray 120). It follows that the first area may include materials that have been formed to securely hold a variety of different spark rod types.

However, a remainder 128*b* of the recessed area may be used to store additional items. In some approaches, the remainder 128*b* may be configured to receive and secure tinder therein while the lid 126 closed (e.g., as seen in FIG. 1C). For example, the bottom surface of the remainder 128*b* of the recessed area may be further indented to receive a magnet of a desired size (e.g., see FIGS. 4A-4F below).

Figure 2B:
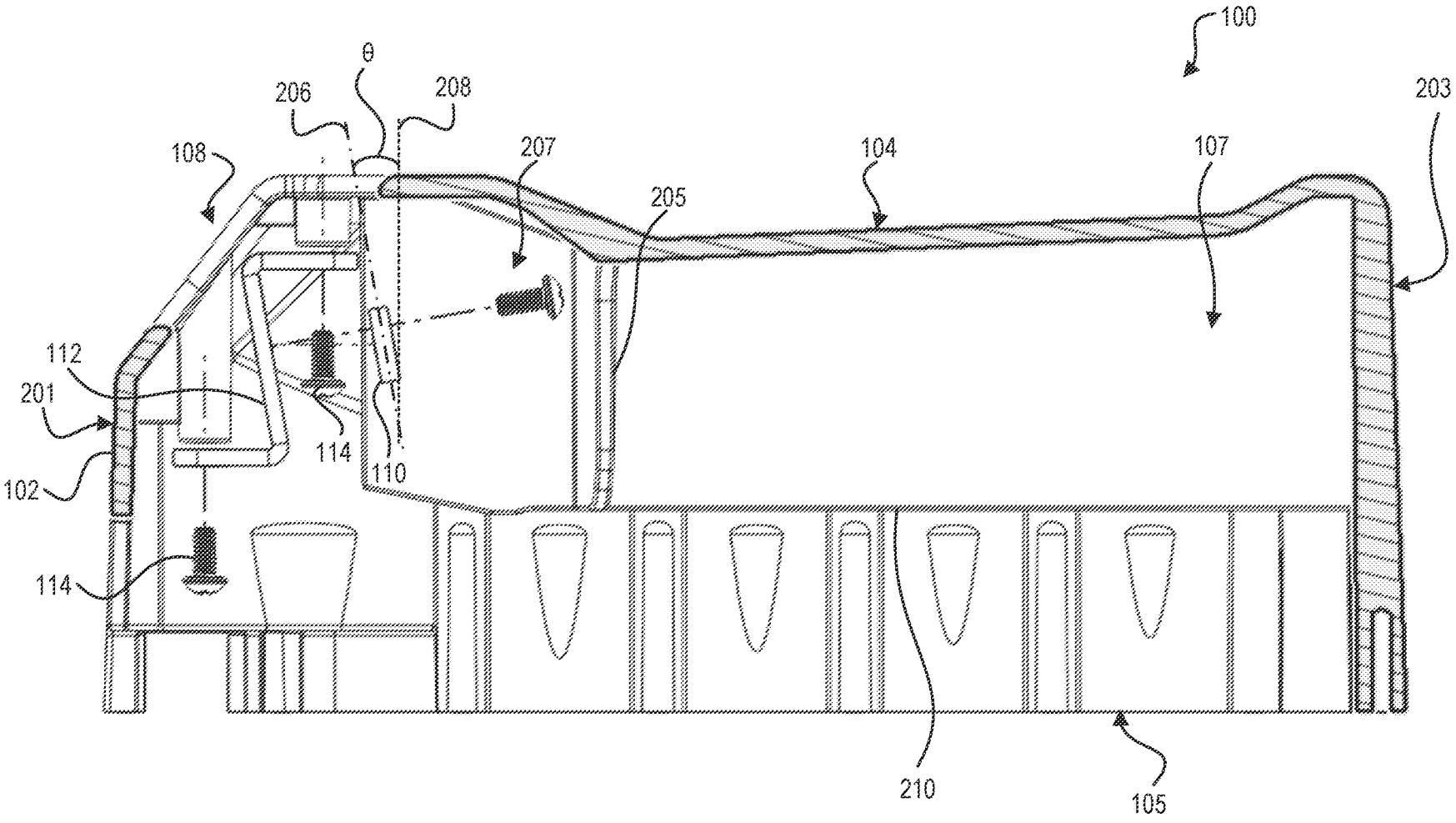
FIG. 2B, is a partially exploded cross-sectional view of a fire-starter, according to one approach.

Referring now to FIG. 2B, a detailed view of the blade 110 and corresponding bracket 112 are illustrated in accordance with one implementation. Accordingly, various components of FIG. 2B have common numbering with those of FIGS. 1A-1C. It follows that the present approach may be implemented in conjunction with features from any other approaches listed herein, such as those described with reference to the other FIGS., such as FIGS. 1A-1C. However, the blade 110 and corresponding bracket 112 may be used in various applications and/or in permutations which may or may not be specifically described in the illustrative approaches listed herein. According to some approaches, the blade 110 is actually a piece of material having a longitudinal plane. For example, the blade may be a rectangular piece of material having a longitudinal plane extending therethrough.

While FIG. 2B includes a partially exploded view, the blade 110 and bracket 112 have not been rotated from their orientations while fixed to the outer shell 102. Thus, the angle θ at which the longitudinal axis 206 of the blade 110 is shown as being rotationally positioned relative to a vertical reference plane 208 may be the same as when the blade 110, bracket 112 and outer shell 102 are coupled to each other. As shown, the vertical reference plane 208 preferably extends relatively parallel to a front sidewall 201 and back sidewall 203 of the fire-starter. However, the orientation of the vertical reference plane in FIG. 2B is in no way intended to be limiting. Rather, the orientation of the blade 110 may be measured relative to one or more other references that produce equivalent determinations, e.g., as would be appreciated by one skilled in the art after reading the present description.

In some approaches, the bracket 112 may be configured to position the blade 110 such that the angle θ is between about 0 degrees and about −20 degrees, more preferably between about −5 degrees and about −15 degrees, still more preferably between about −8 and about −12 degrees, and ideally about −10 degrees. The angle at which the blade 110 is oriented relative to the vertical reference plane 208 affects the interaction between a spark rod and the blade itself. For example, a sharper angle may correspond to a greater transfer of energy into the spark rod, while a shallower angle may correspond to a less efficient transfer of energy.

An edge or surface of the blade 110 that comes into contact with a spark rod inserted in the opening 108 may depend on the size of the spark rod, the orientation of the spark rod, whether a biasing mechanism is located in the fire-starter, etc. Edges of the blade 110 are preferably smooth and not serrated (e.g., non-serrated) to achieve relatively uniform performance regardless of how the spark rod is inserted into the fire-starter.

The material composition of the blade 110 may also vary depending on the particular approach. However, it should be noted that the blade 110 preferably uses materials that are at least a predetermined hardness. For example, materials that have a value of at least 50 on the Rockwell C (RC) scale may be used to form the blade 110, more preferably a value of at least 60 on the RC scale, still more preferably a value of at least 62 on the RC scale. Accordingly, the blade 110 may include one or more hardened metals or ceramics. For example, a non-limiting example of a material that may be used to form the blade 110 includes high speed steel (HSS) with an RC rating of about 62. The HSS may further be heat treated before having the edges of the blade 110 reground. In another non-limiting example, the blade 110 may include one or more different types of zirconia (e.g., such as zirconia-3y-tzp). In still another example, the blade 110 may include colored zirconia.

Referring still to FIG. 2B, the interior portion 107 of the outer shell 102 is also shown as including interior walls 210. For instance, the interior walls 210 extend along the interior portion 107 from the upper end 104 of the outer shell 102 towards the bottom (e.g., lower end 105) of the outer shell 102. As seen in the cross-sectional view of FIG. 2B, the interior walls 210 also extend from the back sidewall 203 towards the front sidewall 201. In some approaches, the interior walls 210 may thereby be configured to direct airflow from the opening 108 towards a center of the interior portion 107.

This is desirable, as the airflow generated by the sidewalls directing airflow from the opening 108 direct the sparks formed by the spark rod towards a fuel source positioned towards the bottom of the interior portion of the outer shell. It should also be noted that the interior walls 210 are configured in some approaches to stabilize the tray in the secured position. In other words, the interior walls 210 may extend sufficiently into the interior portion 107 that a tray and outer shell 102 are firmly coupled to each other while in the secured position.

Figure 3A:
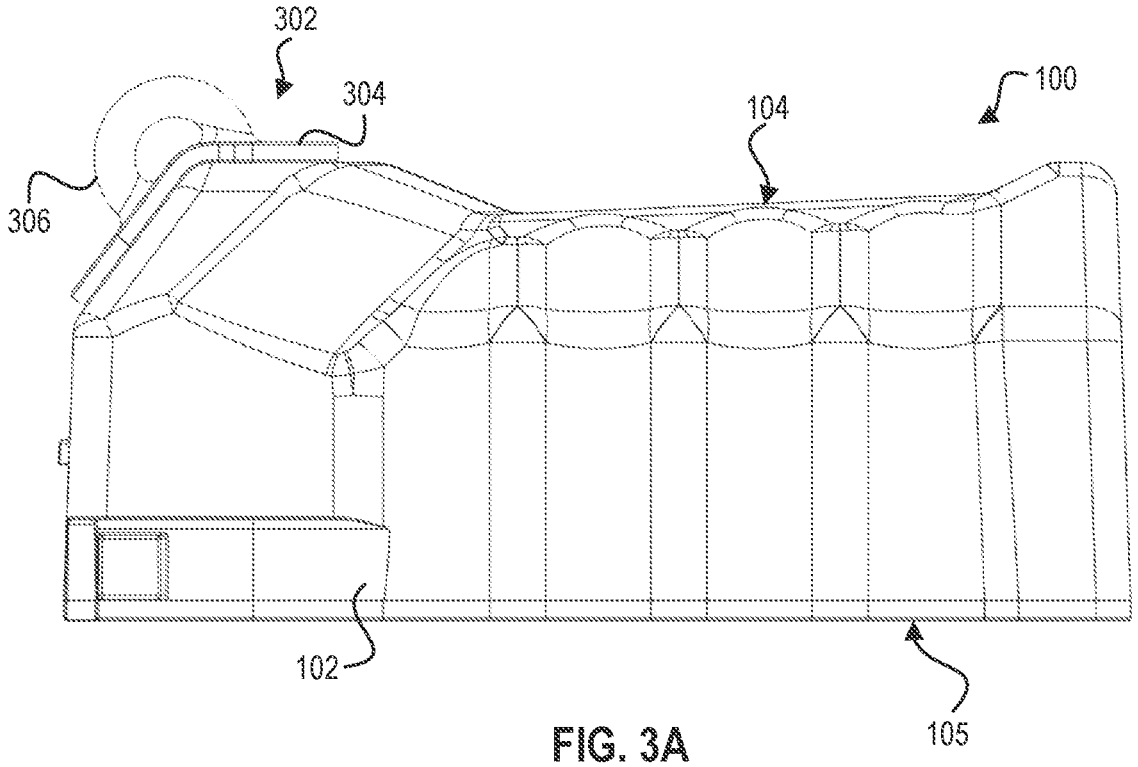
FIG. 3A is a right side-view of a fire-starter having a cap inserted, according to one approach.
Figure 3B:
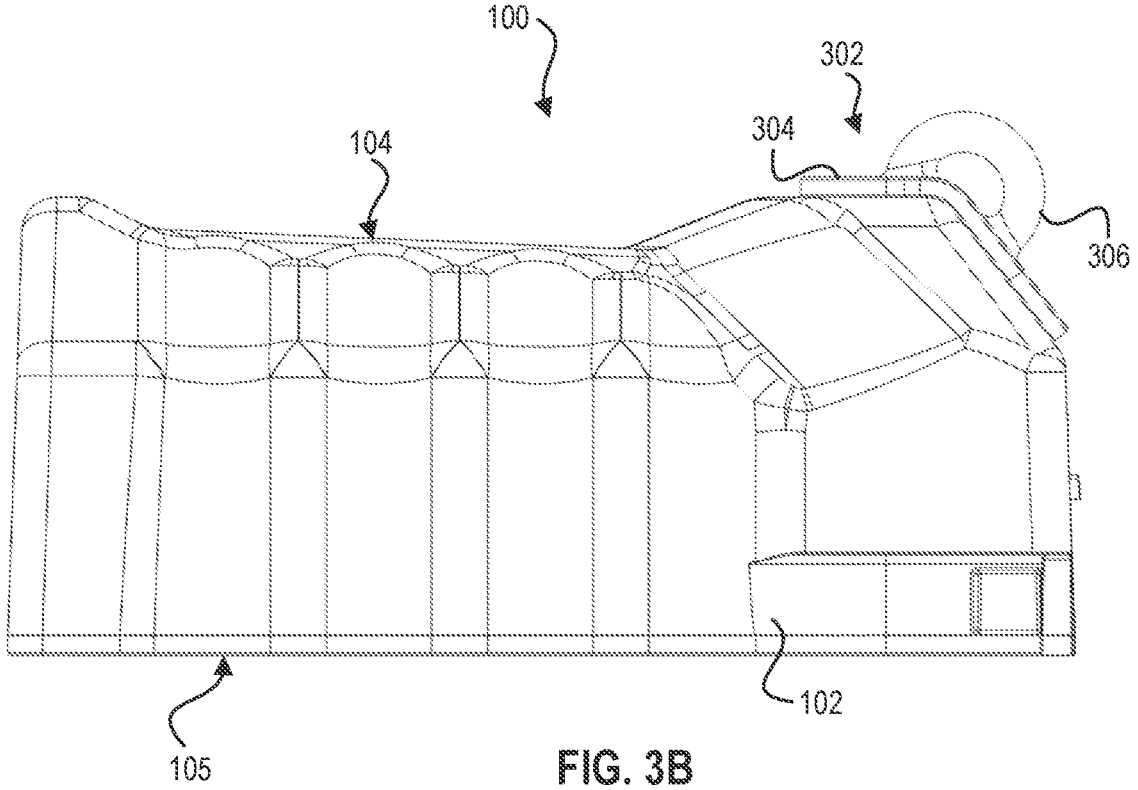
FIG. 3B is a left side-view of the fire-starter in FIG. 3A, according to one approach.
Figure 3C:
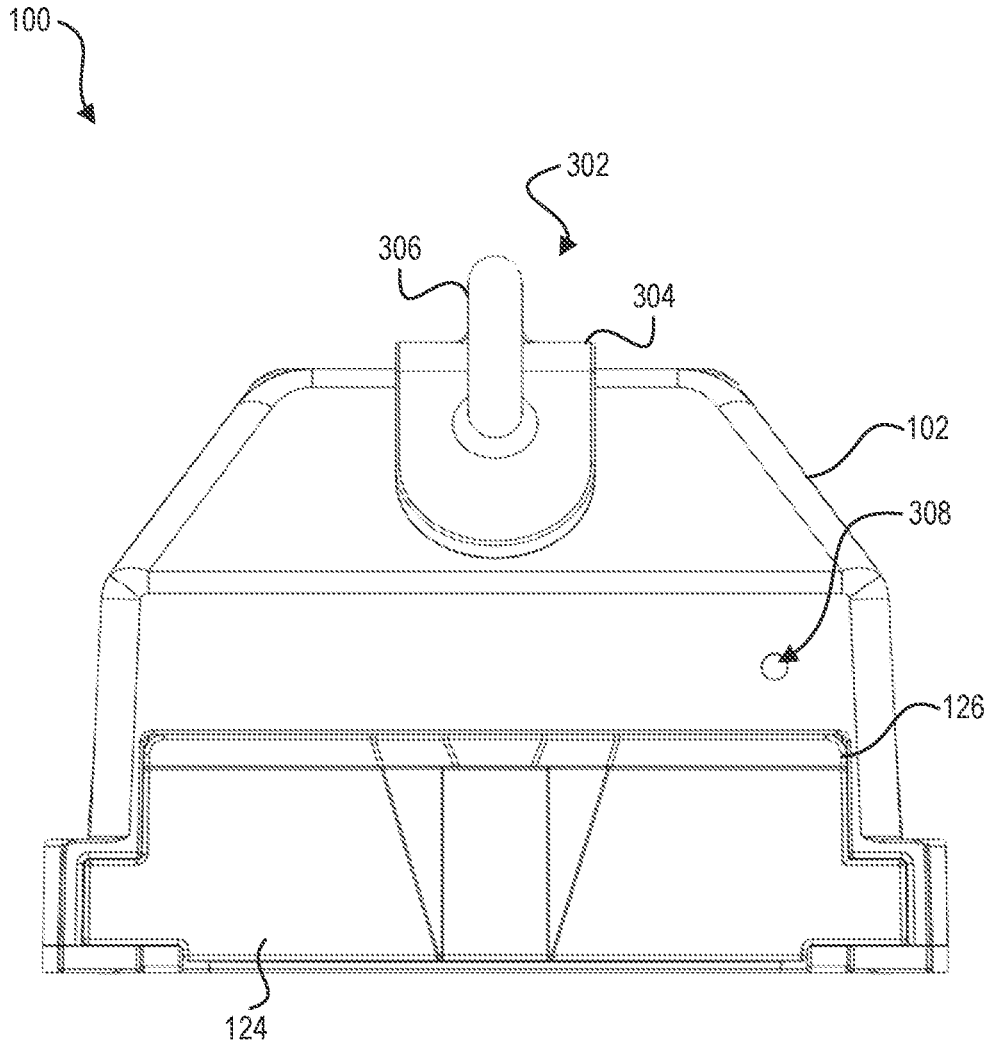
FIG. 3C is a front-view of the fire-starter in FIG. 3A, according to one approach.

Referring now to FIGS. 3A-3C, side-profile views of the fire-starter 100 having a cap 302 are illustrated in accordance with one implementation. Accordingly, various components of FIGS. 3A-3C have common numbering with those of FIGS. 1A-1C. It follows that the present approach may be implemented in conjunction with features from any other approaches listed herein, such as those described with reference to the other FIGS., such as FIGS. 1A-1C. However, the fire-starter 100 and cap 302 may be used in various applications and/or in permutations which may or may not be specifically described in the illustrative approaches listed herein.

As shown, the cap 302 includes a base 304 and an attachment point 306. The base 304 of the cap 302 preferably covers the opening such that the blade 110 is protected from any damage and/or unintentional wear. The cap 302 may also help seal (e.g., protect) the interior portion 107 while the fire-starter 100 is not in use. It should also be noted that the cap 302 shown in FIGS. 3A-3C is in no way intended to be limiting. For example, the attachment point 306 and/or base 304 may be reconfigured such that two or more fire-starters 100 can be easily stacked on top of each other. In other words, the cap 302 may be reconfigured to have a lower profile. In some approaches, the cap 302 may even be configured to nest in a recessed portion of another fire-starter 100.

Looking specifically to FIG. 3C, it should also be noted that a through hole 308 is positioned on a front face of the outer shell 102. In other words, the through hole 308 extends fully through the outer shell 102, providing a small channel into the interior portion 107. This through hole 308 may be used to fix a lanyard or similar type of attachment to the fire-starter 100. This may provide a user with easier manipulation of the fire-starter 100, particularly before and after use.

Looking to FIGS. 4A-4F, different views of a tray 120 are shown in accordance with some approaches. As an option, the tray 120 shown may be implemented in conjunction with features from any other approach listed herein, such as those described with reference to the other FIGS., such as FIGS. 1A-1C. However, the tray and others presented herein may be used in various applications and/or in permutations which may or may not be specifically described in the illustrative approaches listed herein. Thus FIGS. 4A-4F (and the other FIGS.) may be deemed to include any possible permutation.

Figure 4A:
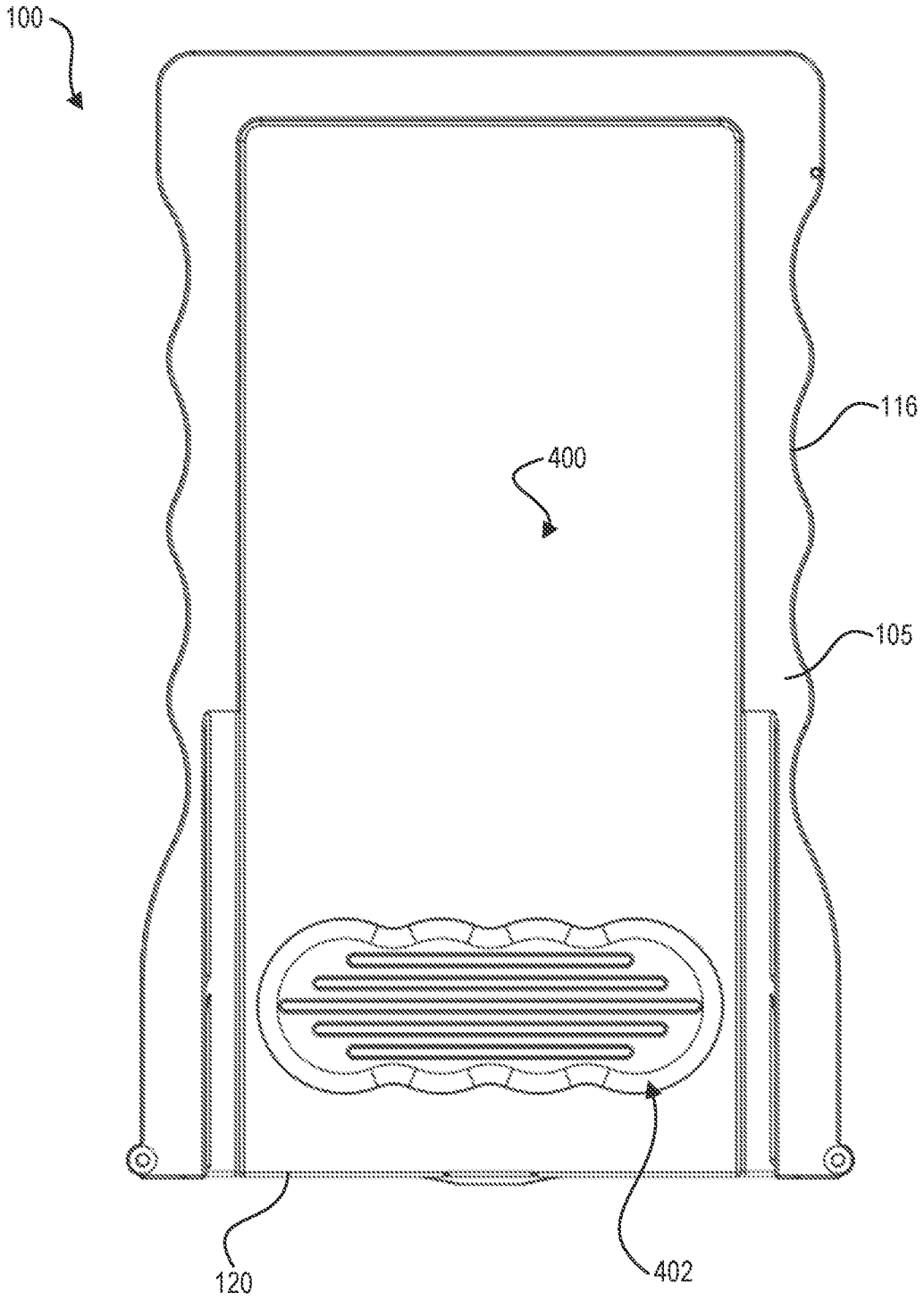
FIG. 4A is a bottom-view of a fire-starter with a tray in the secured position, according to one approach.

Looking first to FIG. 4A, a bottom surface 400 of the tray 120 and the lower end 105 of the outer shell 102 are shown in accordance with one approach. As shown, the bottom surface 400 of the tray 120 includes a textured area 402. The textured area 402 is preferably configured to assist in creating a force to remove the tray 120 from the secured position. For example, in situations where the fire-starter is placed on a surface such that the bottom surface is in contact with the surface, applying downward force on the outer shell 102 creates an increased (e.g., focused) normal force against the textured area 402, thereby reducing the amount of lateral force associated with removing the tray 120 from a remainder of the fire-starter 100. It follows that the textured area 402 may include one or more predetermined materials, raised patterns, adhesives, etc. It should also be noted that additional textured areas may be present along the bottom of the tray 120. In some approaches, the entire bottom of the tray 120 may be textured with one or more different textures to help facilitate easy removal of the tray 120, stability of the fire-starter 100 while stored (e.g., not in use), etc.

Figure 4B:
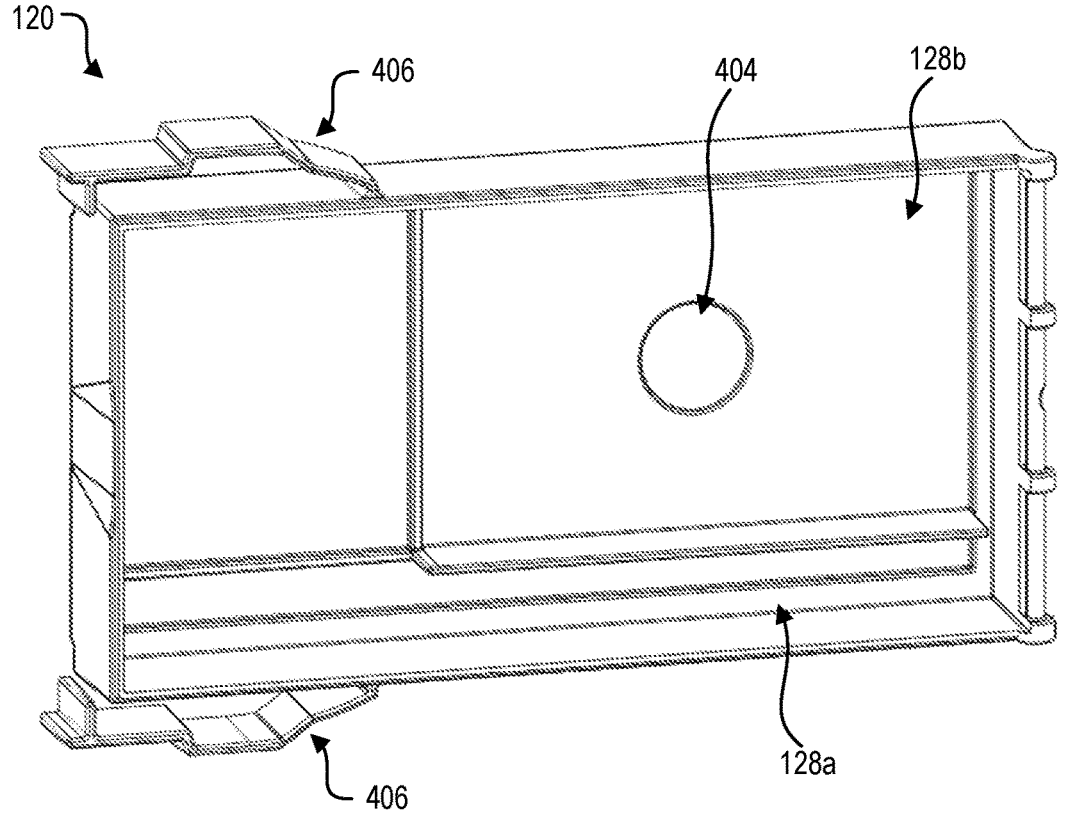
FIG. 4B is a partial perspective view of a tray base, according to one approach.
Figure 4C:
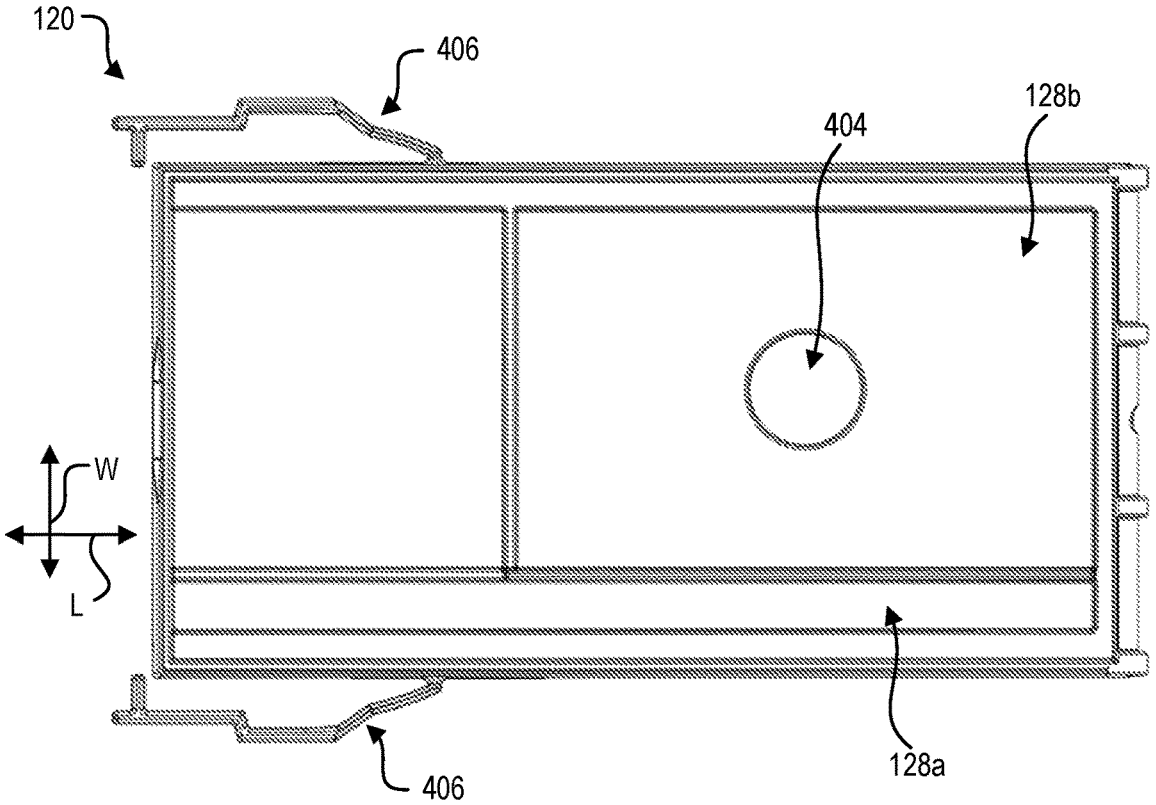
FIG. 4C is a top-down view of the tray base in FIG. 4B, according to one approach.
Figure 4D:
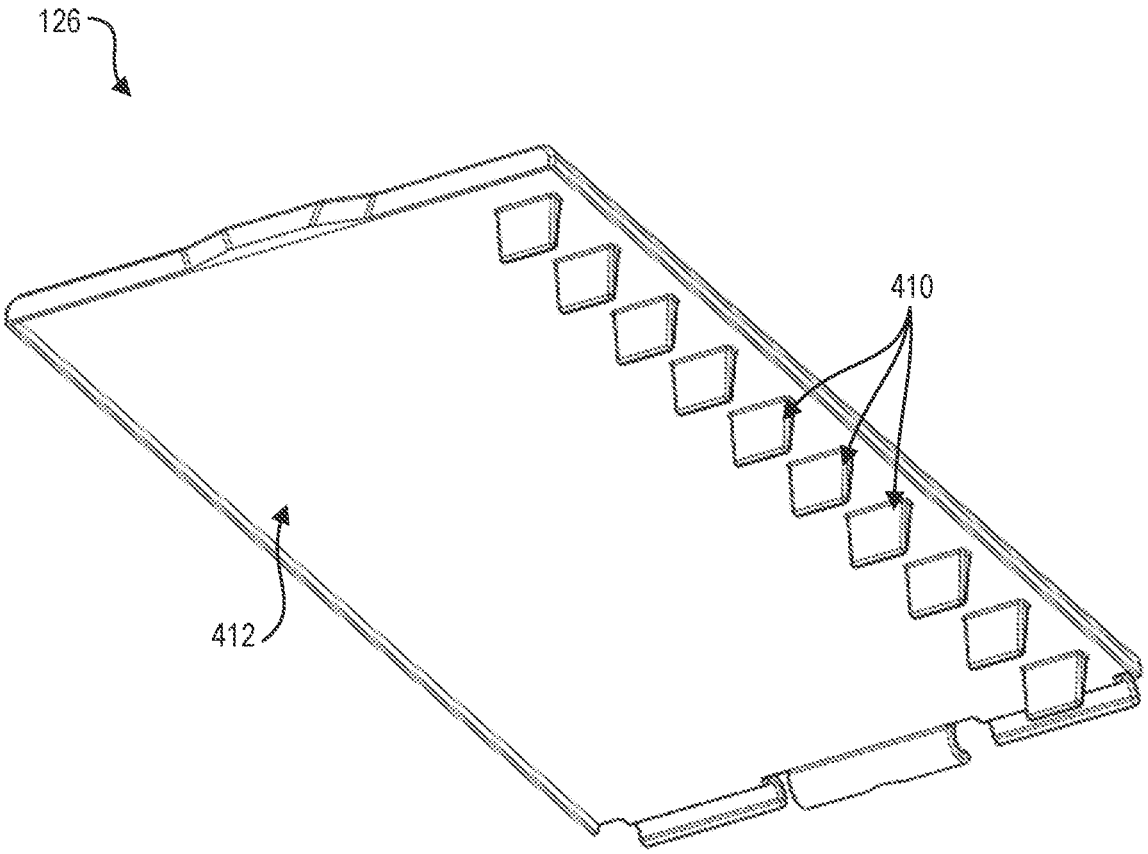
FIG. 4D is a partial perspective view of a tray lid, according to one approach.

Looking now to FIGS. 4B-4C, prospective and top-down views of the tray 120 are shown in accordance with an illustrative approach. The bottom surface of the remainder 128*b* of the recessed area includes an indented area 404 that may be configured to receive a magnet of a desired size. The magnet is preferably fixed in the indented area 404 (e.g., using adhesive) such that it is flush with the bottom surface of the area 128*b*. Accordingly, an object may lay flat along a bottom of the recessed area 128 and a magnet recessed in the indented area 404 is able to provide a high attractive force on magnetic (e.g., metallic) objects. In some instances, the remainder 128*b* of the recessed area may be configured to receive a tin of a specific size and a recessed magnet further resists the tin from moving while the fire-starter 100 and/or tray 120 are being transported.

According to an example, the remainder 128*b* of the recessed area may be configured to receive and secure a metallic container with a removable lid. In such example, the remainder 128*b* may have a length L of about 3.75 inches, a width W of about 2.45, and a depth (measured in a direction perpendicular to the length L and width W plane) of about 0.8 inches. However, it should be noted that the specific dimensions that are provided are in no way intended to be limiting, and the remainder 128*b*, the first area 128*a*, and/or any other portions of the recessed area 128 (e.g., such as the indented area 404) may be changed to accommodate components of desired dimensions and/or general shapes. This, in combination with a magnet secured in the indented area 404 reduces the amount of noise generated by components stored within the fire-starter 100, which in turn increases its utility in noise sensitive environments.

Latching mechanisms 406 may also be used to secure the tray 120 in the opening of the fire-starter (e.g., see opening 122 of FIGS. 1A-1B). It follows that a lateral force applied by a user to both latching mechanisms 406 along the width W of the tray 120 may release the tray from being secured in the opening. However, the tray 120 may be secured to a remainder of the fire-starter using different components in other approaches. For example, one or more fasteners, indents, hooks, lanyards, etc. may be used to secure the tray 120 to a remainder of the fire-starter 100. Thus, the tray 120 may be slid into a recess in the outer shell 102 in some approaches, while in other approaches the tray 120 may be snapped into place, friction fit into place, twisted into place, etc. In other words, the tray 120 may be nested in a remainder of the fire-starter 100.

It should be noted that features in the recessed area 128 of the tray may be configured to work in combination with features implemented on the lid 126 of the tray 120. For example, the first area 128*a* of the recessed area 128 may be configured (e.g., have specific dimensions) to work in combination with extensions along an inner surface of the lid. Looking to FIGS. 4D-4F, extensions 410 are shown as extending from the inner surface 412 of the lid 126. The extensions 410 are preferably configured so that they come in close proximity to a spark rod placed in the first area 128*a*. In some approaches, the extensions 410 may include a resiliently deformable material (e.g., rubber, silicon, springs, etc.) that is able to secure spark rods of different sizes.

Figure 4E:
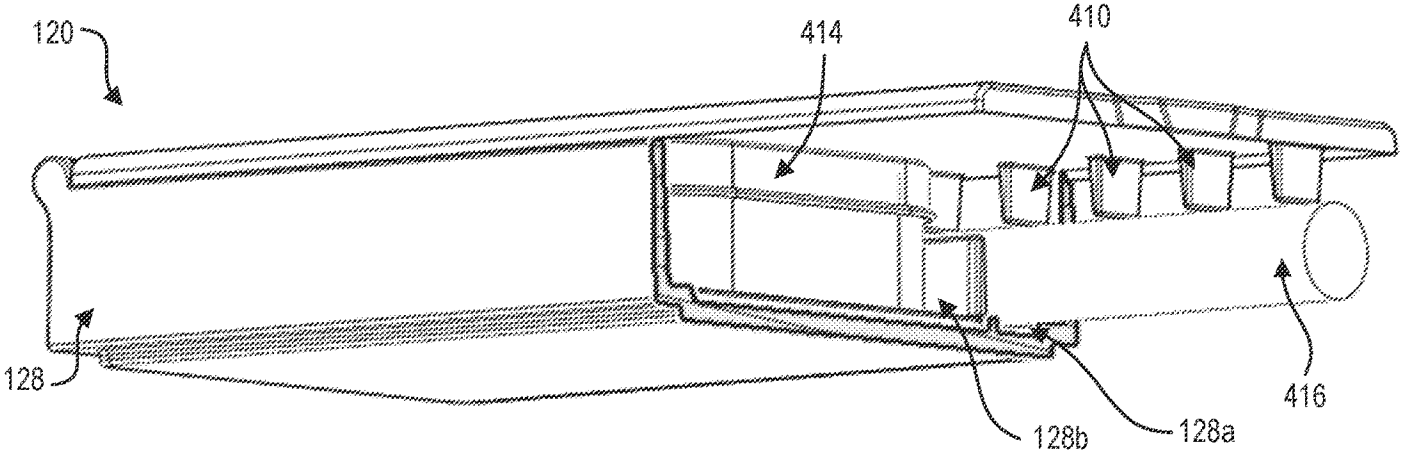
FIG. 4E is a partial perspective cutaway view of a tray, according to one approach.
Figure 4F:
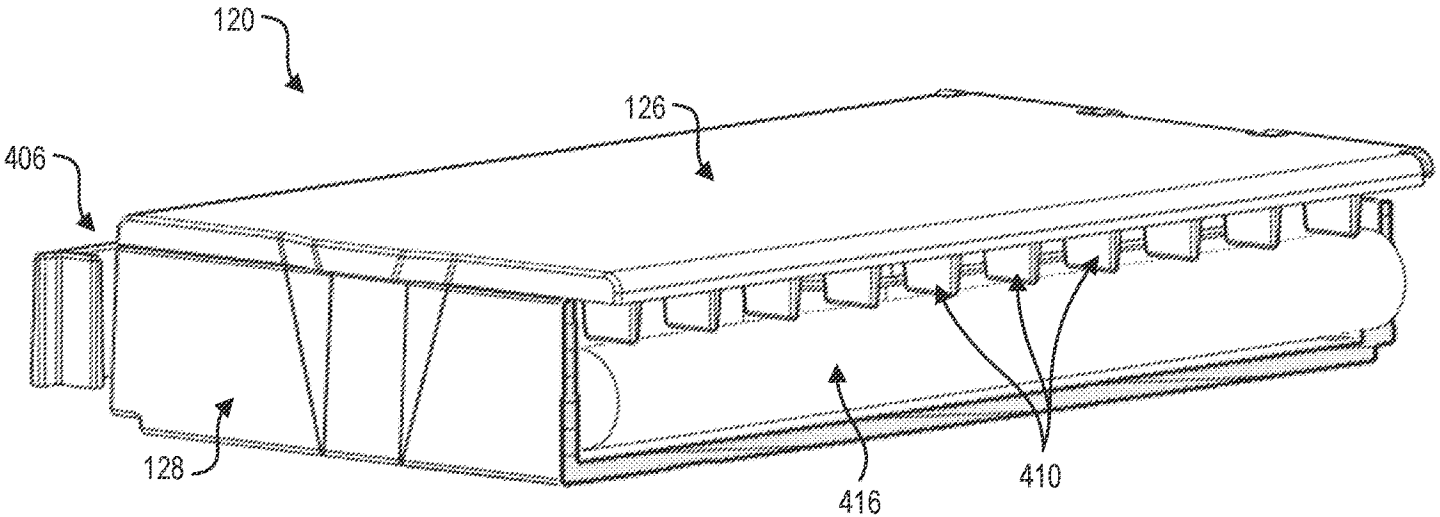
FIG. 4F is a partial perspective cutaway view of the tray in FIG. 4E, according to one approach.

FIGS. 4E-4F show the lid 126 and recessed area 128 coupled together, with cutaway views to see how components stored inside the tray 120 is secure. For instance, a tin 414 is shown as being securely positioned in the remainder 128*b*, while spark rod 416 is securely positioned in the first area 128*a*. As noted above, the extensions 410 are configured to secure the spark rod 416 such that movement in the tray 120 and sound is minimized.

Figure 5A:
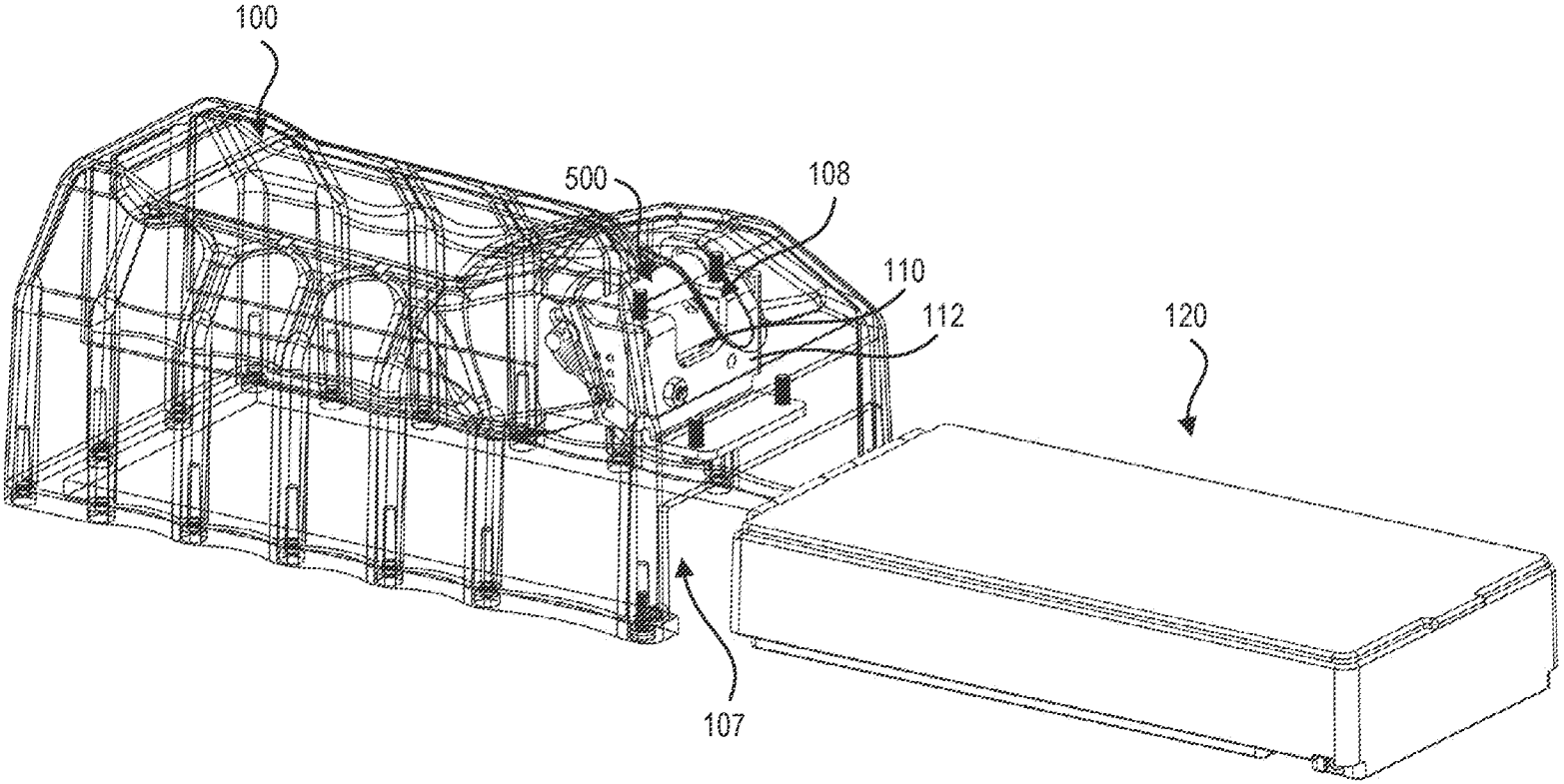
FIG. 5A is a partial perspective view of a fire-starter having a biasing mechanism, according to one approach.
Figure 5B:
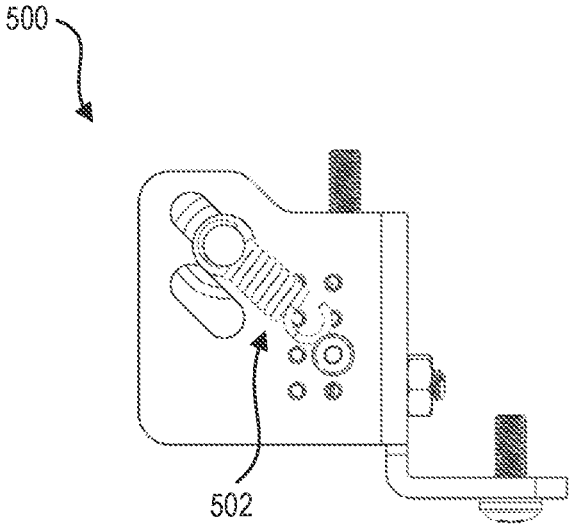
FIG. 5B is a side-view of the fire-starter in FIG. 5A, according to one approach.
Figure 5C:
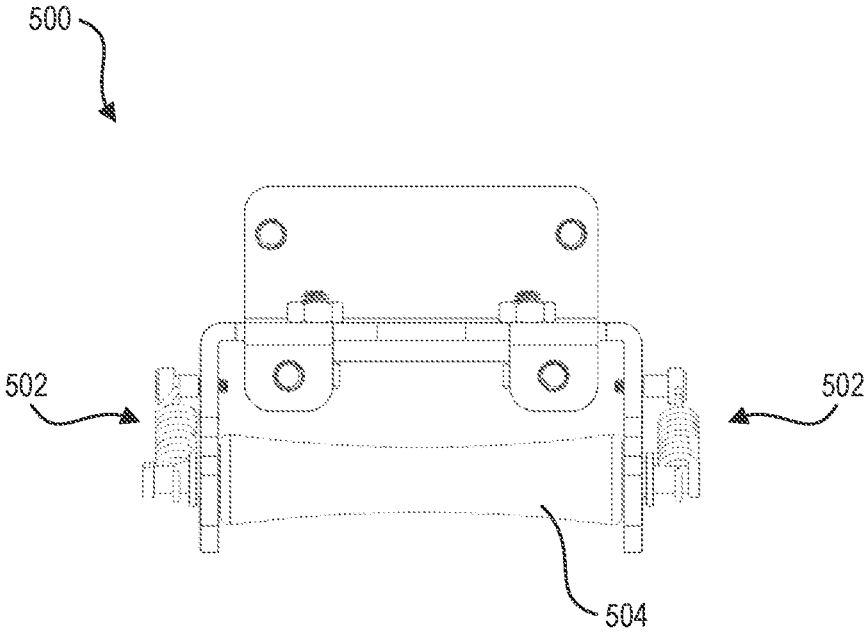
FIG. 5C is a front-view of the fire-starter in FIG. 5A, according to one approach.

Looking now to FIGS. 5A-5C, different views of the fire-starter 100 having a biasing mechanism 500 are illustrated in accordance with one implementation. Accordingly, various components of FIGS. 5A-5C have common numbering with those of FIGS. 1A-1C. It follows that the present approach may be implemented in conjunction with features from any other approaches listed herein, such as those described with reference to the other FIGS., such as FIGS. 1A-1C. However, the fire-starter 100 and biasing mechanism 500 may be used in various applications and/or in permutations which may or may not be specifically described in the illustrative approaches listed herein.

Looking first to the partial perspective view in FIG. 5A, the biasing mechanism 500 is shown as being positioned in the interior portion 107. The biasing mechanism 500 is also shown as being adjacent to the opening 108, but at least partially positioned on an opposite side of the opening 108 as the blade 110 and bracket 112. As noted above, the biasing mechanism is preferably configured to direct a spark rod inserted into the first opening towards the blade, and exert a force on the spark rod while the spark rod is in contact with the blade. Thus, by placing the biasing mechanism 500 on an opposite side of the opening 108 as the blade 110, the biasing mechanism 500 is able to force a spark rod into the blade 110. This increases energy transfer, resulting in larger and hotter sparks being produced.

Looking at the detailed side views of the biasing mechanism 500 in FIGS. 5C-5C, the present implementation is depicted as including a number of springs 502. These springs 502 bias a contact beam 504 towards the blade 110 on the opposite side of the opening 108. It follows that as a spark rod is inserted into the opening 108, it may pass along the contact beam 504 such that the springs 502 bias the rod into contact with the blade, e.g., as would be appreciated by one skilled in the art after reading the present description.

It should also be repeated that the biasing mechanism 500 illustrated in FIGS. 5A-5C is in no way intended to be limiting. For instance, the extension springs may be replaced with one or more compression springs, leaf springs, torsion springs, etc., in other implementations.

While various approaches have been described above, it should be understood that they have been presented by way of example only, and not limitation. Thus, the breadth and scope of an approach of the present invention should not be limited by any of the above-described exemplary approaches, but should be defined only in accordance with the following claims and their equivalents.

What is claimed is:

1. A fire-starter comprising:

an outer shell having (i) an upper end, and (ii) sidewalls coupled to the upper end, wherein the sidewalls and upper end together form an interior portion of the outer shell, wherein the interior portion of the outer shell includes interior walls that extend from the upper end of the outer shell towards the bottom of the outer shell, wherein the interior walls form a chamber that is configured to direct airflow from the first opening towards a center of the interior portion of the outer shell;

a first opening in the outer shell configured to receive a spark rod and provide access to the interior portion of the outer shell; and a blade positioned in the interior portion of the outer shell and adjacent to the first opening, the blade being configured to come into contact with a spark rod inserted in the first opening and generate sparks in the interior portion of the outer shell in response to the spark rod being removed from the first opening.

2. The fire-starter as described in claim 1, wherein an outer surface of the outer shell is textured and/or patterned.

3. The fire-starter as described in claim 1, wherein a first end of the sidewalls are coupled to the upper end of the outer shell, wherein a second end of the sidewalls opposite the first end define a bottom of the outer shell.

4. The fire-starter as described in claim 3, wherein the bottom of the outer shell is open.

5. The fire-starter as described in claim 3, wherein the sidewalls and interior portion of the outer shell are configured to receive a tray, wherein the tray and the outer shell are configured to become removably coupled to each other in response to the tray being inserted into a secured position.

6. The fire-starter as described in claim 5, wherein the tray includes (i) a body, and (ii) a lid, wherein the body of the tray includes a bottom and sidewalls that form a recessed area, wherein the lid is configured to be removably coupled to the body of the tray to cover the recessed area.

7. The fire-starter as described in claim 6, wherein an area in the recessed area of the tray is configured to receive and secure a spark rod therein while the lid is removably coupled to the body of the tray, wherein an area in the recessed area of the tray is configured to receive and secure tinder therein while the lid is removably coupled to the body of the tray.

8. The fire-starter as described in claim 5, comprising:

a locking mechanism configured to lock the tray in the secured position.

9. The fire-starter as described in claim 5, wherein the interior walls are configured to stabilize the tray in the secured position.

10. The fire-starter as described in claim 9, wherein the interior walls are configured to direct the generated sparks from the first opening towards a center of the interior portion of the outer shell.

11. The fire starter as described in claim 1 wherein the blade includes one or more hardened metals or ceramics.

12. The fire-starter as described in claim 11, wherein the interior walls form a chamber that is configured to contain the generated sparks and direct the generated sparks along with airflow from the first opening towards a center of the interior portion of the outer shell.

13. The fire-starter as described in claim 12, wherein the chamber has a volume that is about one quarter of the interior portion of the outer shell.

14. The fire-starter as described in claim 1, wherein an edge of the blade configured to come into contact with the spark rod is a non-serrated edge.

15. The fire-starter as described in claim 1, wherein the blade is a piece of material having a longitudinal plane, wherein the blade is removably coupled to the outer shell by a bracket configured to position the blade in the interior portion of the outer shell such that the longitudinal plane of the blade is between about 0 degrees and about −5 degrees from a vertical reference plane.

16. The fire-starter as described in claim 15, wherein the bracket is configured to position the blade in the interior portion of the outer shell such that the longitudinal plane of the blade is about 0 degrees from the vertical reference plane.

17. The fire-starter as described in claim 15, wherein the vertical reference plane extends parallel to two of the sidewalls.

18. The fire-starter as described in claim 1, wherein the outer shell includes one or more materials selected from the group consisting of: plastics, metals, and rubbers.

19. The fire-starter as described in claim 1, comprising:

a biasing mechanism positioned in the interior portion of the outer shell and adjacent to the first opening, wherein the biasing mechanism is positioned on an opposite side of the first opening as the blade, wherein the biasing mechanism is configured to:

direct a spark rod inserted into the first opening towards the blade, and exert a force on the spark rod while the spark rod is in contact with the blade, wherein the biasing mechanism includes one or more springs selected from the group consisting of: compression springs, extension springs, and leaf springs.

20. The fire-starter as described in claim 1, comprising:

a cap configured to seal the first opening while inserted therein.

* * * * *